US005259215A

United States Patent [19]

Rocca

[11] Patent Number: 5,259,215

[45] Date of Patent: Nov. 9, 1993

[54] TRANSPORTABLE COOLER DESIGN

[76] Inventor: David D. Rocca, 256 Richmond Ave., Massapequa, N.Y. 11758

[21] Appl. No.: 22,947

[22] Filed: Feb. 26, 1993

[51] Int. Cl.[5] ..... F25D 3/08

[52] U.S. Cl. ..... 62/371; 62/457.1; 62/457.7; 280/47.34; 280/47.26; 280/30

[58] Field of Search ..... 62/457.1, 457.7, 457.9, 62/371, 372; 280/47.34, 87.021, 87.01, 47.26, 30; 190/1, 18 A

[56] References Cited

U.S. PATENT DOCUMENTS 4,724,681 2/1988 Bartholomew et al. ..... 62/457.1

4,846,493 7/1989 Mason ..... 190/18 A

*Primary Examiner*—John M. Sollecito

*Attorney, Agent, or Firm*—Allen R. Morganstern

[57] ABSTRACT

A cooler that allows for its transportability by the selective attachment to the cooler structure of axle and wheel assembly to the undercarriage of the cooler as desired. By the affixing to the undercarriage of the cooler mounting blocks that are capable of selectively receiving the axle portion of a wheel and axle assembly in rotational mechanical inter-fit, the features and advantages of the proposed invention are achieved.

3 Claims, 1 Drawing Sheet

TRANSPORTABLE COOLER DESIGN

BACKGROUND AND OBJECTS OF THE INVENTION

The present invention relates generally to a new and improved cooler capable of being selectively modified to receive wheel and axle assemblies so as to transform said cooler into a transportable structure.

Although prior art devices existed prior to the present invention that addressed themselves to cooler structures, none of the prior art devices achieve the advantages of the present invention nor are such prior art devices capable of providing the overall achievements consistent with the present design.

In conjunction with the above, it should be noted that the prior art considered relevant to date by applicant, but which does not anticipate nor teach the present invention is as follows. More particularly, reference is made to U.S. Pat. No. 2,317,871 to H. F. Zimmerman, entitled "PORTABLE REFRIGERATOR CONTAINER"; U.S. Pat. No. 3,591,194, to Philip Vega, entitled, "ICE CHEST CART"; U.S. Pat. No. 4,724,681, to Bartholomew et al, entitled, "PORTABLE, WHEELED COOLER APPARATUS"; U.S. Pat. No. 4,743,038, to Myers et al, entitled, "CARRYING CASE AND CART"; U.S. Pat. No. 4,846,493, to Donald W. Mason, entitled, "PORTABLE COOLER WITH RETRACTABLE WHEELS"; and U.S. Pat. No. 4,873,841, to Bradshaw et al, entitled, "PORTABLE COOLER".

In keeping with the invention, it is, therefore, an object of the present invention to create a new and improved transportable cooler capable of being selectively modified to receive wheel and axle assemblies so as to transform said cooler into a transportable structure.

It is another object of the invention to create a new and improved cooler wherein wheel and axle assemblies are capable of selective mechanical interfit with mounting blocks affixed to the undercarriage of the cooler structure so as to enable the transformation of a cooler into one that is capable of being rolled across a horizontal and/or inclined surface.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements hereto shown and described.

SUMMARY OF THE INVENTION

The present invention is directed to a new and improved design for a cooler that allows for its transportability by the selective attachment to the cooler structure of axle and wheel assemblies to the undercarriage of the cooler as desired.

By the affixing to the undercarriage of the cooler mounting blocks that are capable of selectively receiving the axle portion of a wheel and axle assembly in rotational mechanical interfit, the features and advantages of the proposed invention are achieved.

In keeping with the invention, the mounting blocks fixed to the undercarriage of the cooler define a hemispherical indent compatible with the diameter of the axle portion of the wheel and axle assembly so as to achieve an ability to forcibly snap into or out of place the axle portion of the wheel and axle assembly within the hemispherical indent formed within each mounting block. By so doing, the advantages of the invention are in fact achieved.

SUMMARY OF THE INVENTION

Figure 1:
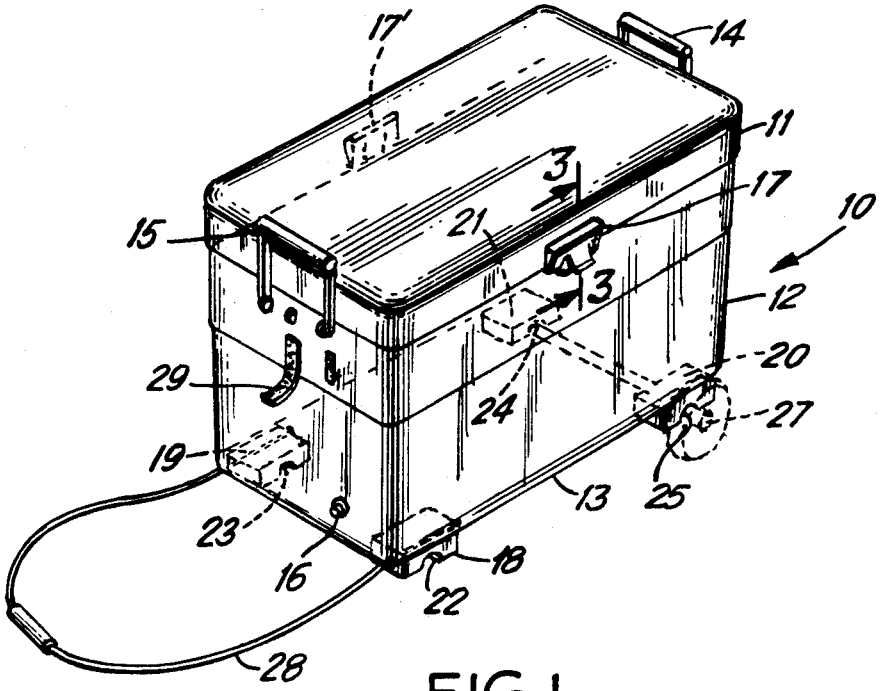
FIG. 1 is a three dimensional perspective view of a cooler constructed in accordance with the invention.

Referring now more particularly to the embodiment of the above invention as illustrated in the accompanying drawings, reference is now made to FIG. 1 wherein there is depicted a three dimensional view of cooler 10 constructed in accordance with the invention.

As therein illustrated, cooler 10 comprises lid li, wall structure 12 and undercarriage 13.

In keeping with the above, wall structure 12 and undercarriage 13 are formed and otherwise comprised of a singular unitary construction in a manner and fashion well known within the prior art wherein lid 11 fits upon the opening formed by wall structure 12 so as to provide a structural interfit capable of achieving a thermal seal between wall structure 12 and lid 11 thereby providing a means to maintain a temperature level within cooler 10 different than that of the surrounding atmosphere.

As depicted in FIG. 1, handle member 14 and handle member 15 are rotatably affixed to the exterior of wall structure 12 as illustrated in FIG. 1, same being in a manner and fashion well known in the prior art. Additionally, drain plug 16 is also formed through the body of wall structure 12 as illustrated in FIG. 1 in a manner well known in the prior art so as to allow for the selective draining of any accumulated liquid that occurs within the interior of cooler 10.

Furthermore, locking means 17 as depicted in FIG. 1 indicates a clasp arrangement well known within the prior art as a means to selectively retain lid member 11 in its closed position with regard to wall structure 12 of cooler 10 as illustrated in FIG. 1. It should be noted that as set forth in the preferred embodiment depicted in FIG. 1, a locking means similar to locking means 17 as depicted on the side face of cooler 10 is similarly affixed to lid member 11 on the back side of cooler 10 and on the opposite face thereof and designated as locking means 17' such that lid member 11 is capable of being affixed to wall structure 12 of cooler 10 by two separate and distinct locking means, each on opposite sides of the cooler, to wit, locking means 17 and locking means 17'. Thus, to remove lid member 11, one must release locking means 17 and locking means 17' so as to thereby enable one to physically lift lid member 11 vertically away from wall structure 12 as depicted in FIG. 1.

Additionally, and in keeping with the invention, mounting blocks 18, 19, 20 and 21 are structurally affixed to the undercarriage of cooler 10 as illustrated in FIG. 1. In keeping with the invention, mounting blocks 18, 19, 20 and 21 have formed within their structure a circular indent 22, 23, 24 and 25 respectively. It should be noted that circular indents 22, 23, 24 and 25 each define an arch there within whose radius is slightly greater than the radius of axle 27 and whose length of arch is greater than one-half (½) of the circular cross section of axle 27. In this manner, and as depicted in the drawings, axle 27 is capable of providing a snap fit with circular indents 22 and/or 23 and/or 24 and/or 25 as the case may be as related to mounting blocks 18, 19, 20 and 21 respectively.

Figure 2:
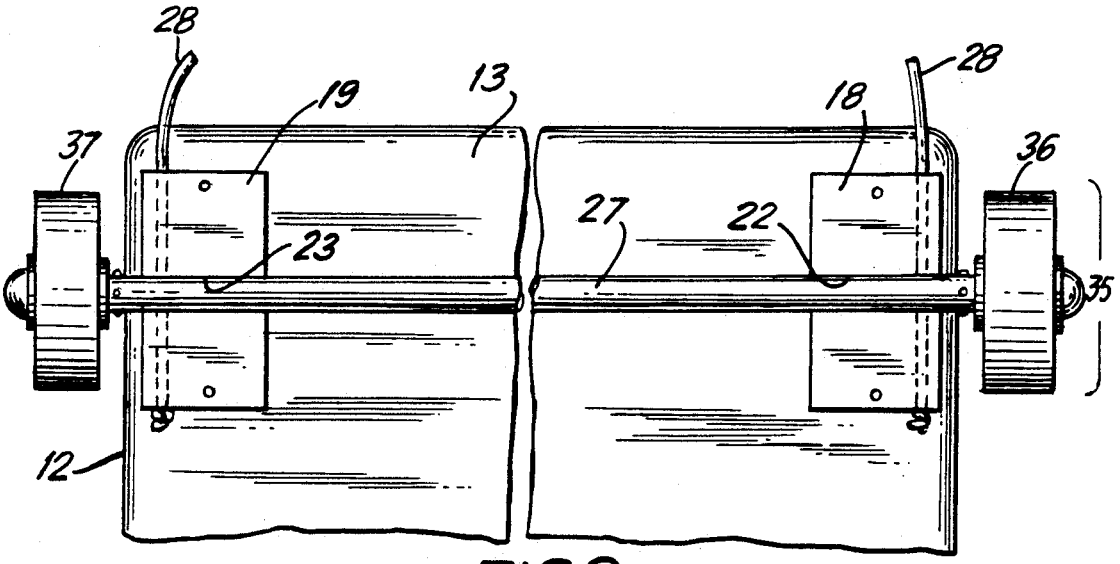
FIG. 2 is a partial bottom view of the cooler depicted in FIG. 1 wherein there is depicted the mounting of the wheel and axle assemblies to mounting blocks affixed to the undercarriage of said cooler in accordance with the invention.

In conjunction with the invention and referring to FIG. 2, there is depicted a partial bottom view of cooler 10 as depicted in part in FIG. 1 wherein there has been structurally affixed to mounting blocks 18 and 19 respectively axle 27.

As further illustrated in FIG. 2, there is formed through mounting blocks 18 and 19 respectively a hollow opening running the length thereof as therein depicted such that cord 28 has its ends passing therethrough and knotted at the ends as depicted in FIG. 2 so as to form a loop as illustrated in FIG. 1 thereby providing a means to assist in the pulling of cooler 10.

Additionally, in further keeping with the invention, and, as depicted in FIG. 1, there is structurally affixed to the front face of cooler 10 loop member 29, same being constructed in the preferred embodiment of "velcro" material, capable of interlocking with itself so as to provide an open loop such that cord 28 may be selectively placed within the open loop formed by loop member 29 so as to avoid having cord 28 lie upon the ground when not being utilized to pull cooler 10.

Figure 3:
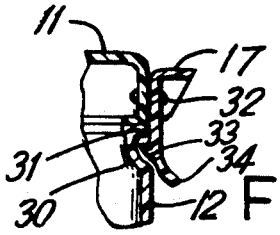
FIG. 3 is partial cross-sectional view taken along lines 3—3 of FIG. 1.

Reference is now herein made to FIG. 3 wherein there is depicted a partial cross sectional view taken along lines 3—3 of FIG. 1.

More particularly, FIG. 3 addresses itself to a cross sectional view of locking means 17 (locking means 17' being identical to locking means 17) as depicted in FIG. I. It should be noted that locking means 17 is well known in the prior art and is merely illustrative of a mechanism whereby lid 11 is capable of being selectively affixed to wall structure 12 of cooler 10 by the utilization of locking means 17 and 17' as indicated in FIG. 1.

More particularly, as set forth in FIG. 3, wall structure 12 has formed at the location of locking means 17 an indent 30 in said wall structure and a locking edge 31 is formed as part of wall structure 12 as depicted in FIG. 3, wall structure 12, indent 30 and locking edge 31 evidencing one continuous structure.

Affixed to lid 11 as depicted in FIG. 3 is locking means 17, locking means 17 being structurally affixed to lid 11 by fastener 32. It should be noted that the structure of locking means 17 is such as to define a structure wherein lip member 33 of locking means 17 as depicted in FIG. 3 is structurally adjacent to locking edge 31. As depicted in FIG. 3, lid 11 is prevented from vertical movement as a result of the fact that lip member 33 abuts against locking edge 31 so as to prevent such vertical movement. In keeping with the invention, locking means 17 is fashioned from resilient flexible material such as polypropylene plastic such that lip member 33 can rotate away from locking edge 31 so as to in fact clear locking edge 31 thereby allowing for the vertical removal of lid 11, the above being achieved due to the flexibility inherent in the material by which locking means 17 is fabricated as indicated above. To assist in unlocking lid 11 from cooler 10, lifting edge 34 is formed as part of locking means 17, thereby providing a gripping surface to enable the counter clockwise movement of lip member 33.

It should be noted that locking means 17' as depicted in FIG. 1 is identical in structure to that of locking means 17 as illustrated in FIG. 3 and FIG. 1 and as a result, no repetition of discussion will be addressed to describe locking means 17' other than as herein set forth.

In keeping with the invention, and as depicted in FIG. 2, wheel assembly 35 consists of axle 27 and wheel members 36 and 37. As therein depicted, and as is well known in the prior art, wheel member 36 and wheel member 37 are mechanically affixed to axle 27 at the end portions of axle 27 respectively, and through known mechanical means are structurally affixed at said representative end locations of axle 27 so that said wheel members 36 and 37 are capable of rotation movement about the axis of axle 27 while axle 27 does not rotate about its axis.

As depicted in FIG. 2, and in keeping with the invention, axle 27 is cable of being able to be mechanically snapped into structurally alignment with mounting block 18 and mounting block 19 respectively as a result of the fact that mounting block 18 and mounting block 19 are fashioned from resilient material such as polypropylene plastic as well as due to the fact that the diameter of axle 27 is slightly less than the diameter of the circle indents 22 and 23 of mounting blocks 18 and 19 respectively. Additionally, because of the fact that the circular indents 22 and 23 of mounting blocks 18 and 19 define an arch slightly greater than a hemisphere whose radius is that of the arch defined by circular indents 22 and 23 respectively, there is achieved the capability to have axle 27 snap into and out of structural contact with mounting blocks 18 and 19.

It should be noted that two wheel assemblies are in fact utilized in conjunction with this invention both of same being identical to wheel assembly 35 as referred to above and as depicted in FIG. 2. In keeping with the invention, a wheel assemblies is utilized as depicted in FIG. 2 not only in conjunction with mounting blocks 18 and 19, but also with mounting blocks 20 and 21, the inter-relationship between said wheel assembly and said mounting blocks being as set forth above.

In carrying out the features of the invention, there is the ability to selectively affix to undercarriage 13 and cooler 18, a pair of wheel assemblies identical to wheel assembly 35 so as to selectively affix to cooler 10 two pairs of wheels so as to allow for the pulling of cooler 10 across a surface. In this fashion, one is able to roll cooler 10 as opposed to being required to physically lift same so as to re-locate it. Should there be a desire to utilize cooler 10 without said wheel assembly, then there is such an option afforded to the user of cooler 10 since the wheel assemblies that mechanically inter-fit with mounting blocks 18, 19, 20 and 21 as illustrated in FIG. 2 can be selectively removed from being mechanically interlocked with cooler 10 merely by causing the axle associated with each of the wheel assemblies to be mechanically snapped out of structural contact with the representative mounting blocks 18, 19, 20 and 21.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

I claim:

1. A cooler structure designed to allow for transverse movement across a surface comprising:

(a) A walled structure defining a rectangular walled enclosure constructed from thermally insulative material;

(b) An undercarriage member structurally affixed to said rectangular walled structure so as to form a unitary structure thereby defining a cavity comprising said undercarriage and said rectangular walled enclosure, constructed from thermally insulated material;

(c) A lid member, capable of a selective structural compatibility fit with said wall structure, said lid member being constructed from thermally insulative material.

(d) A first pair of mounting blocks structurally affixed to said undercarriage and aligned at one end of said undercarriage opposite to each other, each of said mounting blocks defining a partial cylindrical cavity formed therein, said first pair of mounting blocks being of a resilient composition;

(e) A second pair of mounting blocks structurally affixed to said undercarriage and aligned at the end of said undercarriage opposite to where said first pair of mounting blocks are structurally affixed to said undercarriage, and positioned opposite to each other, each of said mounting blocks of said second pair of mounting blocks defining a partial cylindrical cavity formed therein, each pair of said mounting blocks being of a resilient composition;

(f) A first wheel assembly capable of selective mechanical interfit with said first pair of mounting blocks comprising:

(i) A first axle member whose diameter is such that said first axle member and said partial cylindrical cavities formed in said first pair of mounting blocks define means whereby said first axle member can be selectively snapped into and out of mechanical interfit with said first pair of mounting blocks as related to said partial cylindrical cavities formed therein;

(ii) A first wheel member rotatably mechanically affixed to one end of said first axle member;

(iii) A second wheel member rotably mechanically affixed to said first axle member but at the end thereof opposite to where said first wheel member is rotably mechanically affixed to said first axle member.

(g) A second wheel assembly of selective mechanical interfit with said second pair of mounting blocks comprising;

(i) A second axle member whose diameter is such that said second axle member and said partial cylindrical cavities formed in said second pair of mounting blocks define means whereby said second axle member can be selectively snapped into and out of mechanical interfit with said second pair of mounting blocks as related to said partial cylindrical cavities formed therein;

(ii) A third wheel member rotably mechanically affixed to one end of said second axle member; and (iii) A fourth wheel member rotably mechanically affixed to said second axle member but at the end thereof opposite to where said third wheel member is rotably mechanically affixed to said second axle member.

2. A cooler structure designed to allow for transverse movement across a surface as set forth in claim "1" wherein a cord member has each of its ends structurally affixed to one each respectively of said first pair of mounting blocks so as to provide the ability to pull said cooler structure across a surface.

3. A cooler structure designed to allow for transverse movement across a surface as set forth in claim "1" wherein said first pair of mounting blocks and said second pair of mounting blocks are each constructed from a resilient plastic composition.

* * * * *

UNITED STATES PATENT AND TRADEMARK OFFICE

CERTIFICATE OF CORRECTION

PATENT NO. : 5,259,215

DATED : Nov. 9, 1993

INVENTOR(S) : David Della Rocca

It is certified that error appears in the above-indentified patent and that said Letters Patent is hereby corrected as shown below:

On the title page, item [76], the inventor's name should read --David Della Rocca Signed and Sealed this Tenth Day of May, 1994

*Attest:*

*Attesting Officer*

BRUCE LEHMAN

*Commissioner of Patents and Trademarks*